United States Patent [19]

Hasenack

[11] Patent Number: 4,510,874

[45] Date of Patent: Apr. 16, 1985

[54] BURNER AND PROCESS FOR THE PARTIAL COMBUSTION OF SOLID FUEL

[75] Inventor: Hendrikus J. A. Hasenack, Amsterdam, Netherlands

[73] Assignee: Shell Oil Company, Houston, Tex.

[21] Appl. No.: 590,090

[22] Filed: Mar. 16, 1984

[30] Foreign Application Priority Data

Mar. 18, 1983 [GB] United Kingdom ..... 8307519

[51] Int. Cl.[3] ..... F23D 1/00

[52] U.S. Cl. ..... 110/347; 110/263; 239/424.5; 239/433

[58] Field of Search ..... 110/263, 264, 265, 347; 239/145, 433, 424.5

[56] References Cited

U.S. PATENT DOCUMENTS 3,130,252 4/1964 Metz ..... 239/424.5 X
3,823,872 7/1974 Frenzl ..... 239/424.5 X
3,937,007 2/1976 Kappler ..... 239/145 X
4,173,189 11/1979 Cooper ..... 110/263 X
4,350,103 9/1982 Poll ..... 110/264

*Primary Examiner*—Edward G. Favors

[57] ABSTRACT

A burner for the partial combustion of a finely divided solid fuel in a combustion zone, comprising a central channel for finely divided solid fuel, an annular channel for free-oxygen containing gas, substantially concentrically surrounding the central channel. The annular channel is provided with primary, inclined outlet means for directing high velocity free-oxygen containing gas into the outflowing solid fuel during operation and secondary outlet means around the primary outlet means for conveying shielding low velocity free-oxygen containing gas to the combustion zone.

The invention further relates to a process for the partial combustion of a finely divided solid fuel, wherein one or more burners of the above type are applied.

12 Claims, 6 Drawing Figures

BURNER AND PROCESS FOR THE PARTIAL COMBUSTION OF SOLID FUEL

BACKGROUND OF THE INVENTION

The present invention relates to a burner for use in a partial-combustion process for producing synthesis gas from a finely divided solid fuel, such as pulverized coal. The invention further relates to a process for the partial combustion of a finely divided solid fuel, in which process such a burner is used.

The generation of synthesis gas is achieved by the partial combustion, also called gasification, of a hydrocarbonaceous fuel with free-oxygen at relatively high temperatures. It is well known to carry out the gasification in a reactor into which solid fuel and free-oxygen containing gas are introduced either separately or premixed at relatively high velocities. In the reactor a flame is maintained in which the fuel reacts with the free-oxygen at temperatures above 1000° C. The solid fuel is normally passed together with a carrier gas to the reactor via a burner, while free-oxygen containing gas is introduced into the reactor via the same burner either separately or premixed with the solid fuel. Great care must be taken that the reactants are effectively mixed with one another. If the reactants are not brought into intimate contact with one another, the oxygen and solid fuel flow will follow at least partially independent trajectories inside the reactor. Since the reactor space is substantially filled with hot carbon monoxide and hydrogen, the oxygen will react rapidly with these gases and the very hot combustion products, carbon dioxide and steam, will follow independent trajectories having poor contact with the relatively cold solid fuel flow. This behavior of the oxygen will result in local hot spots in the reactor and may cause damage to the reactor refractory lining and increase the temperature surrounding the burner.

In order to attain a sufficient mixing of solid fuel with oxygen it has already been proposed to mix the fuel and oxygen in or upstream of the burner prior to introducing the fuel into a reactor zone. This has the disadvantage in that, especially at high pressure gasification, the design and operation of the burner are highly critical. The reason for this is that the time elapsing between the moment of mixing and the moment the fuel/oxygen mixture enters into the reactor zone must be invariably shorter than the combustion induction time of the mixture. The combustion time, however, shortens at a rise in gasification pressure. If the burner is operated at a low fuel load or, in other words, if the velocity of the fuel/oxygen mixture in the burner is low, the combustion induction time may be easily reached in the burner itself, resulting in overheating with the risk of severe damage to the burner.

The above problem of premature combustion in the burner itself, might be overcome by mixing the fuel and oxygen outside the burner in the reactor zone itself. In the latter case, special measures should be taken to ensure as good mixing of fuel and oxygen, necessary for a proper gasification. A drawback of mixing fuel and oxygen in the reactor itself outside the burner is, however, the risk of overheating of the burner front due to the hot flame caused by premature contact of oxygen with already formed carbon monoxide and hydrogen in the reactor. To promote a uniform mixing of fuel and oxygen, it is known to introduce the oxygen as high velocity jets into the fuel zone. Such high velocity jets, however, entrain the reactor gases rapidly. The higher the oxygen jet velocities, the more pronounced will be the contact of oxygen with already formed reactor gases. Entrainment of reactor gases by the oxygen jets along the burner may further cause damage to the burner front due to overheating caused said gas flows.

SUMMARY OF THE INVENTION

The object of the present invention is to provide an improved burner for the partial combustion of finely divided solid fuel in which the above problems attending mixing of fuel and oxygen outside the burner in the reactor are substantially eliminated.

The burner for the partial combustion of a finely divided solid fuel according to the invention thereto comprises a central channel for conveying a finely divided solid fuel to a combustion zone, an annular channel for free-oxygen containing gas substantially concentrically surrounding the central fuel channel. The annular channel is provided with primary, inclined outlet means for directing high velocity free-oxygen containing gas into the outflowing solid fuel during operation. A secondary outlet means substantially surrounding the primary outlet means conveys shielding low-velocity free-oxygen containing gas to the combustion zone.

During operation of the above burner according to the invention the high velocity gas from the primary gas outlet means causes a break-up of the core of solid fuel from the central channel, so that a uniform mixing of the solid fuel with oxygen, necessary for an effective gasification process, can be obtained. The secondary gas outlet means provides a low velocity gas flow to the combustion zone. This low velocity gas forms a shield surrounding the high velocity gas thereby preventing excessive mixing of oxygen with reactor gases present in the reactor, which might cause zones of overheating when combustion with the reactor gases occurs. The low velocity gas flow has a further function in that it reduces heat fluxes to the burner front caused by excessive flowing of reactor gases along the burner. Another important aspect of the low velocity gas is that it forms a cooling for the burner front, so that complicated internal cooling systems can be deleted.

In a suitable embodiment of the invention the secondary outlet means is formed by a porous wall bounding the annular channel at its downstream end. The primary outlet means may be formed by a plurality of channels embedded in said porous wall. These channels may form an integral part of the porous wall or may be formed by separate tubes connected to the porous wall.

In another suitable embodiment the primary outlet means and the secondary outlet means are arranged in a substantially annular outlet channel, said outlet channel being provided with a separating wall so positioned inside said channel that the outer part of the channel, forming the secondary outlet means widens in downstream direction.

The present invention also relates to a process for the partial combustion of finely divided solid fuel, which process comprises using one or more burners according to the invention, wherein the high velocity free-oxygen containing gas is introduced into a combustion zone with a velocity of about at least 60 m/sec., and the low velocity free-oxygen containing gas is introduced into said zone with a velocity of about at most 10 m/sec.

The velocity of the high velocity free-oxygen containing gas is so chosen that it is sufficient for causing a break-up in the core of solid fuel entering into the combustion zone. The velocity of the low velocity gas is chosen so low that the heat fluxes to the burner caused by contact with reactor gases are kept low and excessive contact of reactor gases with oxygen is obviated.

BRIEF DESCRIPTION OF THE DRAWINGS

The invention will now be further explained by way of example only with reference to the accompanying drawings in which.

DESCRIPTION OF PREFERRED EMBODIMENTS

Figure 2:
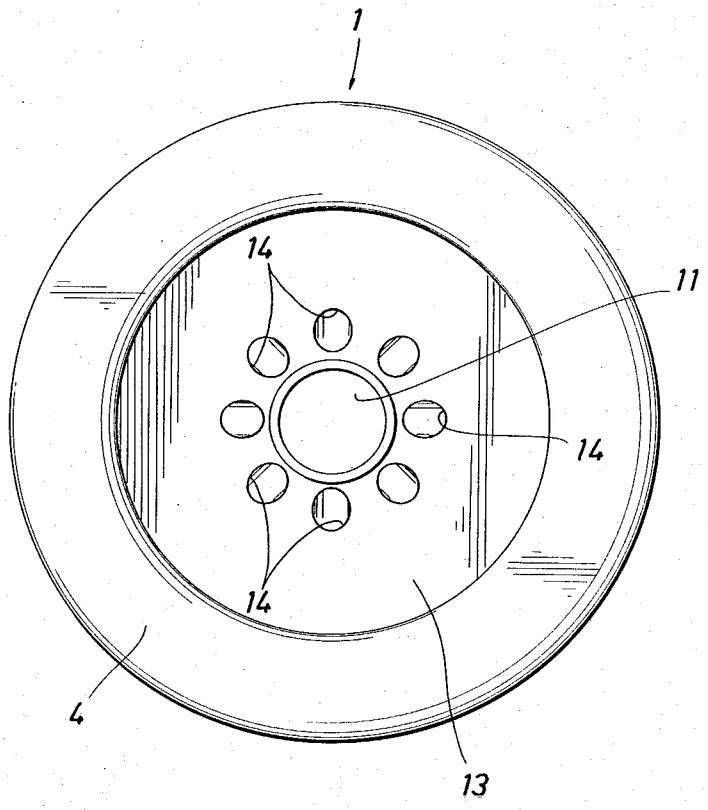
FIG. 2 shows an end view of the burner partly shown in FIG. 1.

It should be noted that identical elements shown in the drawings have been indicated with the same reference numeral.

Figure 1:
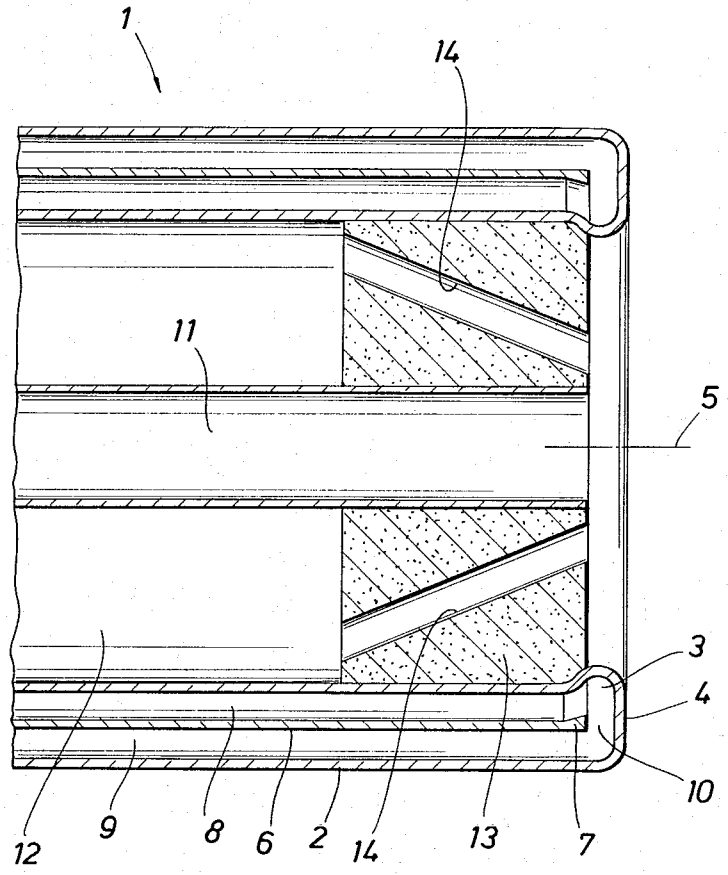
FIG. 1 shows a longitudinal section of the front part of a first burner according to the invention.

Referring to FIGS. 1 and 2, a burner, generally indicated with reference numeral 1, for the partial combustion of a finely divided solid fuel, such as pulverized coal, comprises a cylindrical hollow wall member 2 having an enlarged end part 3 forming a front face 4 which is substantially normal to the longitudinal axis 5 of the burner. The hollow wall member 2' is interiorly provided with a substantially concentrically arranged separating wall 6 with an enlarged end part 7 in the enlarged end part 3 of member 2. The wall 6 divides the interior of the member 2 into passages 8 and 9 and a transition passage 10, through which passages cooling fluid can flow. Supply and discharge of the cooling fluid take place in a known manner via conduit means (not shown). The wall member 2 encloses a substantially cylindrical space in which a central channel 11 for finely divided solid fuel is positioned. An annular channel 12 is provided between wall member 2 and the central channel 11 for supplying free-oxygen containing gas to a combustion space arranged downstream of burner 1. The annular channel 12 is bounded at its downstream end by an annular porous wall 13 having a thickness in the order of magnitude of a few cm. The porous wall 13, supported by the enlarged end part 3 of hollow wall member 2, consists of for example a sintered material with a high heat resistance, such as Inconel, SiN, SiC or a mixture thereof. In the porous wall 13 a plurality of holes are formed, in which holes a plurality of high velocity gas tubes 14 are fitted. As shown in FIGS. 1 and 2 the tubes 14 are inclined with respect to the longitudinal burner axis 5 and are substantially uniformly distributed around the central fuel channel 11, to obtain a uniform mixing of fuel with oxygen during operation of the burner.

At a given inclination of the tubes 14, the thickness and the porosity of the porous wall 13 and the number and width of the tubes 14 are chosen dependent on the required operating conditions. These variables should preferably be so determined that during operation of the burner about 50 through about 70 percent of the free oxygen containing gas leaves the burner via the tubes 14 as high velocity jets and the remaining part of the gas flows through the pores of the porous wall 13 and leaves said wall with a low velocity.

The operation of the shown burner for the partial combustion of for example, coal with oxygen is as follows. Pulverized coal is introduced into a combustion chamber via the central channel 11 of burner 1. For the transport of the coal a carrier gas is normally used, which carrier gas may consist of, for example, steam, carbon dioxide, cooled reactor gas and nitrogen. For combustion of the coal, pure oxygen or an oxygen rich gas is supplied into said combustion chamber via the annular channel 12, the porous wall 13 and the tubes 14. The outlet part of the burner is so designed that the oxygen leaves the burner partly via the primary gas outlet tubes 14 and partly via the porous wall 13 itself. The required velocity in the annular channel 12 depends on the desired velocity of the high velocity gas jets issuing from the tubes 14. The high velocity gas jets are directed towards the coal flow, thereby causing a breaking-up of the coal flow and an intensive mixing of coal with oxygen. The inclination and the velocity of these high velocity gas jets should be chosen so that a penetration of the oxygen in the coal flow is obtained without substantial re-emerging therefrom. The velocity of the high velocity gas jets is preferably at least about 60 m/sec., and even more preferably about 90 m/sec., so that an even and fast mixing of the fuel with the oxygen is attained. The minimum allowable angle of inclination of the high velocity gas jets with respect to the coal flow largely depends on the velocity of these gas jets. At a given velocity the minimum angle of inclination is determined by the impact of the jets on the coal flow necessary for breaking-up thereof. In general, the minimum angle of inclination should be chosen at least about 20 degrees. The maximum angle of inclination should suitably not be chosen greater than about 70 degrees, in order to prevent the formation of a coal-/oxygen flame too close to the burner front. An even more suitable maximum angle of inclination is about 60 degrees. The number of primary gas outlet tubes 14 should be chosen so that sufficient oxygen is injected via these tubes for breaking-up and fully disperse the coal flow.

Part of the oxygen passing through the annular channel 12 leaves the burner via the porous material of the wall 13. At a given number and width of the primary gas outlet tubes 14 and a given gas velocity in the channel 12, the thickness and porosity of the porous wall 13 should be such that the oxygen leaves the wall with a velocity between about 5 m/sec. and about 10 m/sec., for example 6 m/sec. This low velocity oxygen forms a shield around the mixture of coal and primary oxygen, preventing overheating of the burner front, since it considerably suppresses entrainment of reactor gases along the burner front. The low velocity oxygen is entrained by the mixture of coal and primary oxygen at a distance away from the burner front. In this manner the intensive part of the flame, formed after ignition of the coal/oxygen mixture is lifted from the burner front, thereby preventing overheating of the burner front. The low velocity oxygen further cools the porous wall 13, thereby forming a further protection of the burner against overheating.

To keep the flame temperature at the burner front moderate, a substantial amount of combustion oxygen is advantageously introduced into the combustion chamber as low velocity oxygen. A suitable distribution is, for example, 50 percent oxygen as primary oxygen and 50 percent as secondary oxygen.

As shown in FIG. 1, the front part 3 of wall member 2 extends beyond the downstream end of the porous wall 13, thereby forming a shield for the porous wall against fouling.

Figure 4:
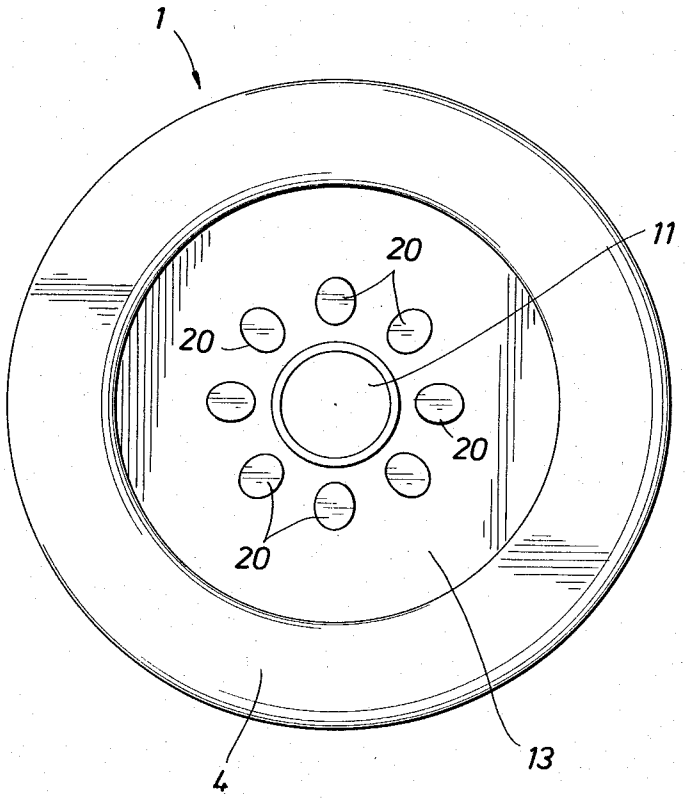
FIG. 4 shows an end view of the burner partly shown in FIG. 3.
Figure 3:
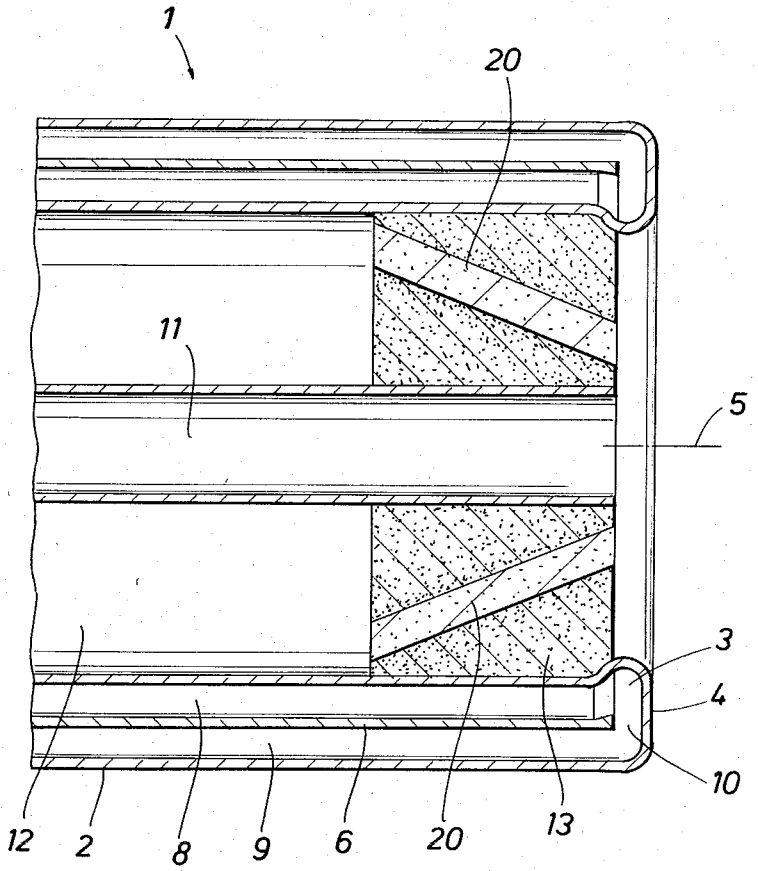
FIG. 3 shows a longitudinal section of the front part of a second burner according to the invention.

Reference is now made to FIGS. 3 and 4, showing an alternative of the above described burner. In this second embodiment the primary gas outlet tubes 14 have been replaced by a plurality of inclined conduits 20, substantially uniformly distributed around the central fuel supply channel 11. These conduits 20, being integral parts of the porous wall 13, are formed by wall portions with a porosity, which is larger than the porosity of the remaining part of wall 13. The assembly of porous wall 13 with conduits 20 might be formed by presintering relatively coarse particles to form the conduits 20, subsequently embedding these presintered elements in a mass of relatively fine particles and sintering the so formed block to complete the porous wall 13.

Figure 6:
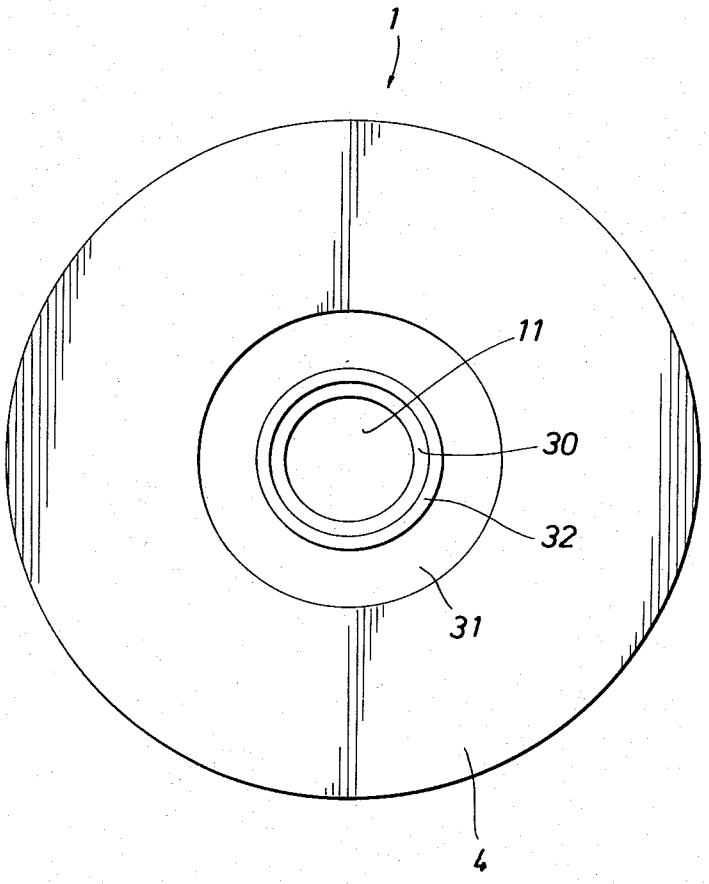
FIG. 6 shows an end view of the burner partly shown in FIG. 5.
Figure 5:
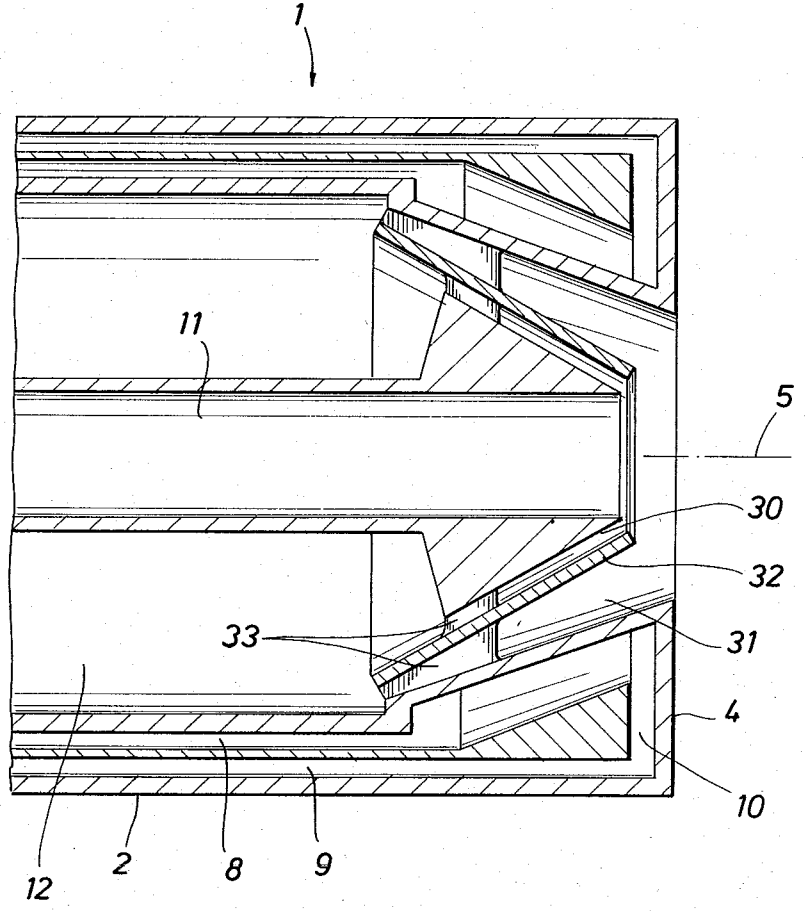
FIG. 5 shows a longitudinal section of the front part of a third burner according to the invention

In the last embodiment of the invention shown in FIGS. 5 and 6, the passage for free-oxygen containing gas from the annular channel 12 into a combustion zone downstream of the burner is formed by two annular channels 30 and 31, being inwardly inclined in downstream direction. The first channel 30 has a substantially constant cross-sectional area over its full length and is intended for directing high velocity gas towards the solid fuel emerging from the central channel 11. By means of these high velocity gases the core of solid fuel is broken up during operation of the burner. The second channel 31, which surrounds the high velocity gas channel 30, is widening in downstream direction, so that the free-oxygen containing gas entering said channel via channel 12 is reduced in velocity and enters into the combustion space with a relatively low velocity. This low velocity gas forms a shield around the fuel and high velocity gas thereby preventing overheating of the burner front, which phenomenon was discussed in more detail hereinbefore with reference to the first shown embodiment of the present invention.

The channels 30 and 31 are separated from one another by an annular separating wall 32 supported by means of a plurality of spacers 33 substantially uniformly distributed over the cross sections of said channels 30 and 31, respectively.

Although FIG. 5 shows a high velocity gas channel 30 with a constant width, it should be understood that it is also possible to apply high velocity channel(s) with a width decreasing in downstream direction. In a variant of the burner shown in FIG. 5 the annular channels 30 and 31 for high velocity gas and low velocity gas, respectively, may be replaced by two series of outlet tubes substantially uniformly distributed around the central channel 11 wherein the outlet tubes of the first series for the high velocity gas have a constant width or a width decreasing in downstream direction, and the outlet tubes of the second series for the low velocity gas surround the first series and have widths increasing in downstream direction. The outlet tubes of the second series for low velocity gas should preferably be so arranged and dimensioned that their outlet ends form an annulus to provide a closed shield of low velocity gas during operation of the burner.

In the embodiments of the invention shown in FIGS. 1 and 3, a plurality of high velocity channels 14 and 20, respectively, are arranged in the porous wall 13. It should be understood that the separate high velocity channels of these burners may be replaced by annular high velocity channels. In this latter embodiment the inner part of the porous wall between the central fuel channel and such an annular high velocity channel may be formed of a solid, non-porous block. The porous wall 13 may be further so arranged as to being inclined at a forward angle with respect to the burner axis in order to introduce low velocity gas with radial moment into a combustion space arranged downstream of the burner.

What is claimed is:

1. A burner for the partial combustion of a finely divided solid fuel with an oxygen containing gas in a combustion zone, said burner comprising:

a central channel for supplying the fuel to the combustion zone;

an annular channel disposed coaxially with said central channel for supplying an oxygen containing gas;

a primary outlet means, said primary outlet means communicating with said annular channel and disposed to direct a high velocity oxygen containing gas flow into the fuel discharged from said central channel; and P1 secondary outlet means, said secondary outlet means communicating with said annular channel and surrounding said primary outlet means, said secondary outlet means being disposed to supply a low velocity oxygen containing shielding gas flow to the combustion zone.

2. The burner of claim 1 wherein the secondary outlet means is formed by a porous wall disposed in the end of said burner and surrounding said central channel.

3. The burner of claim 2 wherein said porous material is a sintered ceramic material.

4. The burner of claim 2 wherein said porous material is a sintered metal material.

5. The burner of claim 2 wherein said primary outlet means are formed by a series of tubes disposed in openings formed in said porous wall.

6. The burner of claim 2 wherein the primary outlet means is an integral part of said porous wall and is formed by increasing the porosity in localized areas of said porous wall.

7. The burner of claim 1 wherein said secondary outlet means is formed by a second annular channel that surrounds said first named annular channel, said second annular channel increasing in cross-sectional area in the downstream direction.

8. The burner of claim 1 wherein said primary outlet means is formed to produce a gas flow of 60 to 90 meters per second and said secondary outlet means is formed to produce a gas flow of 5 to 10 meters per second.

9. A process for the partial combustion of a finely divided solid carbon containing fuel with an oxygen containing gas in a combustion chamber, said process comprising:

introducing the fuel into the combustion zone as a central stream;

introducing a primary flow of the oxygen containing gas into the combustion zone at a velocity of at least 60 m/sec., and in a direction to intersect said fuel stream; and introducing a secondary flow of the oxygen containing gas into the combustion zone at a velocity of not more than 10 m/sec.

10. The process of claim 9 wherein said secondary flow of oxygen containing gas surrounds the primary flow.

11. The process of claim 9 wherein the velocity of the primary flow is about 90 m/sec.

12. The process of claim 9 wherein the velocity of the secondary flow is about 5 m/sec.

* * * * *